US005386609A

United States Patent [19]

Xenos

[11] Patent Number: 5,386,609

[45] Date of Patent: Feb. 7, 1995

[54] BACK WASHING DEVICE

[76] Inventor: Dennis D. Xenos, 3601 W. 26th St., Chicago, Ill. 60623

[21] Appl. No.: 100,721

[22] Filed: Aug. 2, 1993

[51] Int. Cl.[6] ..... A47K 7/02

[52] U.S. Cl. ..... 15/222; 601/138

[58] Field of Search ..... 15/222; 601/138; 401/6, 401/8

[56] References Cited

U.S. PATENT DOCUMENTS

| | | | |
|---|---|---|---|
| 1,232,075 | 7/1917 | Oates | 15/222 |
| 1,379,925 | 5/1921 | Kawasaki . | |
| 1,488,332 | 3/1924 | Foerg . | |
| 2,251,767 | 8/1941 | Steiner . | |
| 2,544,216 | 3/1951 | Brackmann . | |
| 2,691,787 | 10/1954 | Rosenwein . | |
| 2,807,815 | 10/1957 | Mack | 15/222 |
| 2,877,478 | 3/1959 | Kohlwey | 15/244.1 |
| 3,024,486 | 3/1962 | Naugle . | |
| 3,063,081 | 11/1962 | Brown . | |
| 3,099,032 | 7/1963 | Webb | 15/222 |
| 3,124,822 | 3/1964 | Marchese | 15/222 |
| 3,268,938 | 8/1966 | Smith . | |
| 3,737,938 | 6/1973 | Saltzstein | 15/210.1 |
| 3,792,505 | 2/1974 | Saltzstein | 15/147.2 |
| 3,936,198 | 2/1976 | Martin . | |
| 4,016,622 | 4/1977 | Eisenman . | |
| 4,037,591 | 7/1977 | Sarno | 128/65 |
| 4,187,575 | 2/1980 | Collins | 128/63 |
| 4,196,490 | 4/1980 | Jonzon . | |
| 4,672,707 | 6/1987 | Johnson . | |
| 5,035,523 | 7/1991 | Allinder | 15/222 |

FOREIGN PATENT DOCUMENTS

| | | | |
|---|---|---|---|
| 1981 | of 1889 | United Kingdom | 15/222 |
| 19125 | of 1911 | United Kingdom | 15/222 |

OTHER PUBLICATIONS

United States Purchasing Exchange Catalog 1993.
The Gadget Book.
Walter Drake Summer 92 Catalog.

*Primary Examiner*—David A. Scherbel
*Assistant Examiner*—Randall E. Chin
*Attorney, Agent, or Firm*—JoAnne M. Denison

[57] ABSTRACT

The disclosed invention consists of a strap type back washing device with two elongated handles extending from either side from a central pad portion to which is attached an elongated loofah pad member. The elongated loofah pad member may be either permanently attached to the strap by stitching or adhesive, or the loofah pad element may be attached to a backing member which is attached to the strap by fastening means of VELCRO or snaps.

8 Claims, 2 Drawing Sheets

BACK WASHING DEVICE

BACKGROUND OF THE INVENTION

The present invention relates to the area of body washing devices, and more particularly to those suited to cleanse and massage the back of the user by use of a loofah pad. Loofah, or loofah cylindrical, is the fibrous part of a gourd which is commonly available in the marketplace. It is generally used as a skin stimulating or cleansing material, much like a natural sponge.

Loofah has the unique ability to cleanse with minimal retention of water. Because it is fibrous in nature, it has great ability to cleanse and exfoliate skin.

Several prior art patents disclose the use of loofah in back washing devices; U.S. Pat. No. 2,544,216 and 1,488,332, but neither of these patents disclose a simple loofah pad attached to an elongated strap with handles for washing the back of a user. These patents disclose devices utilizing loofah in either an elongated form with simple handles or where loofah is simply strung on a rope. The present invention also anticipates that the pad can be made with hook and loop fasteners or snaps so that it can be readily replaced. Hook and loop fasteners are commonly sold under the trademark VELCRO in the marketplace and are readily available with a variety of backing materials.

According to the present invention, a portion of loofah may be either sewn or secured either directly to the elongated strap with handles for permanent attachment thereto, or it may be sewn or glued with adhesive to a backing pad which is provided with hook and loop fasteners or snaps for easy removal from the strap. Although the natural formation of a loofah gourd is long and cylindrical in shape, the outer cylindrical portion can easily be cut and shaped into either a rectangle or oval or other desireable shape for attachment to an elongated support strap by either stitching it in place or with an adhesive.

The present invention also anticipates that the elongated handles of the strap may be provided with integral open loops at either end so that the user's fingers can be easily placed therethrough and the loofah pad will then be easily manipulated. Several U.S. Patents disclose the use of separate loops or rings such as U.S. Pat. Nos. 3,936,198, 4,016,622, 4,196,490, etc., but because it is anticipated that the elongated strap will be made of a thin sheet of plastic or vinyl or bound plastic fibers, commonly sold under the trademark TYVEK which is very tough in nature, the open loops may be integral with the handles of the strap so the device may be economically produced.

SUMMARY OF THE INVENTION

The present invention consists of an elongated strap type back washing device having a central loofah pad element with a backing member wherein the backing member is provided with fastener elements such as VELCRO hooks or loops or male or female snap elements. The elongated strap has a central portion with corresponding VELCRO hooks or loops or male or female snap elements. These fastening members allow the loofah pad element to be easily replaced by the user when worn or dirty. The outer ends of the strap are provided with open loops which allow the user's fingers to pass therethrough.

Therefore, it is an object of the present invention to provide a strap type back washing device having a central loofah pad which can be easily manipulated across the user's back to massage, cleanse and exfoliate skin.

Therefore, it is a further object of the present invention to provide a strap type back washing device having a central loofah pad which is easily replaced when dirty or worn.

It is a further object of the present invention to provide a strap type back washing device having handle elements and integral open loops at either end for economy of manufacture.

It is yet a further object of the present invention to provide a strap type back washing device which is economical in manufacturer where the loofah pad is not replaceable and the device is discarded when worn or dirty.

These and other objectives and advantages of the present invention will be readily ascertainable from the detailed description and drawings provided herein.

DETAILED DESCRIPTION OF THE DRAWINGS

Figure 1:
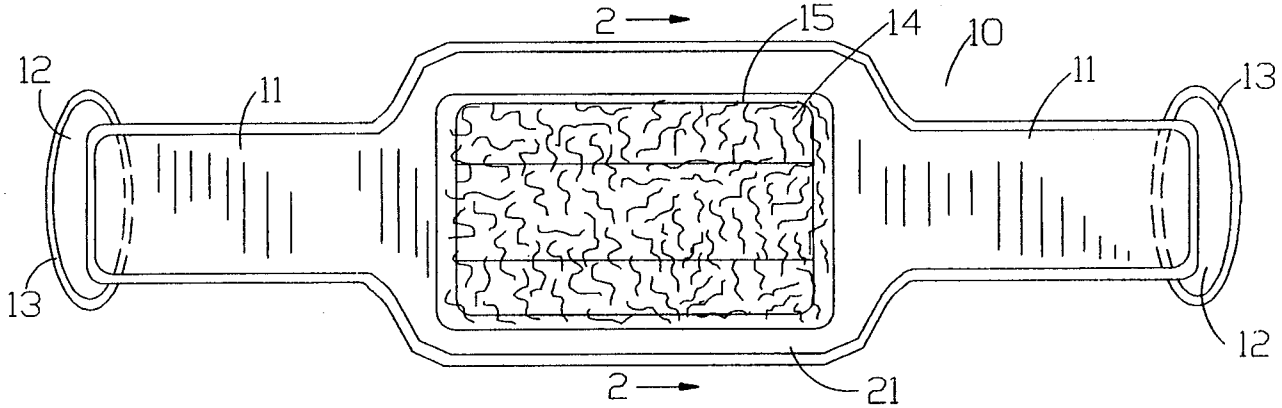
FIG. 1 shows a top plan view of the back washing device.

Referring to FIG. 1, a back washing device 10 is shown with elongated loofah pad element 14. Extending to either side of the elongated loofah pad element 14 are elongated handle members 11. The central portion of the device, central pad support element 21, joins the two elongated hand members 11 together. It is anticipated that both the elongated handle members 11 and the central support element 21 may be integral, for economy of manufacture.

Although FIG. 1 shows a pair of gripping members 13 located along the outer marginal ends of elongated handle members 11, in this illustration the gripping members 13 are shown as separate rings, it is anticipated that elongated handle members 11 may be integral with the gripping members 13 for economy of manufacture. In order to make the central pad member 21 integral with the elongated loofah pad element 14, the backing material must be made from a material such as a vinyl or plastic, or a composite material such as TYVEK, all of which are commonly available in the marketplace.

The gripping members 13 have an open central portion 12 which is oval in configuration so that the fingers of an user may be slipped therethrough by manipulation of the elongated loofah pad element 14 across the user's back.

Although FIG. 1 shows elongated loofah pad element 14 as being essentially rectangular in shape, it is anticipated that other shapes may be used such as oval, square or even irregular shapes which are pleasing in aesthetic form.

Figure 2:
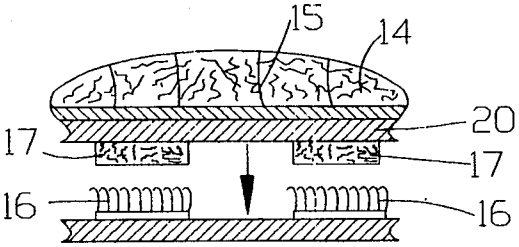
FIG. 2 shows a sectional view of line 2—2 taken on FIG. 1 with a version of the back washing device with miniature hook and loop fasteners.

Referring now to FIG. 2 which is section line 2—2 taken from FIG. 1, there is shown one version of the present invention in which the central support element 21 is attached to a plurality of miniature hooks 16 in order to fasten it securely to loofah pad element 14 with a plurality of miniature loops 17. This fastening system is readily available in the marketplace under the trademark VELCRO.

The loofah pad element 14 is attached to pad backing material 20 which, like the elongated handle members 11, is similarly made from a thin flexible sheet of material such as vinyl or plastic or a composite fibrous material. The pad backing material may be secured to the loofah pad element 14 by a series of stitches 15 which are shown in cross-section in FIG. 2 or is shown in a top view in FIG. 1. FIG. 1 shows stitching 15 along the outer periphery of elongated pad element 14 as well as a series of channels along the length thereof.

Figure 3:
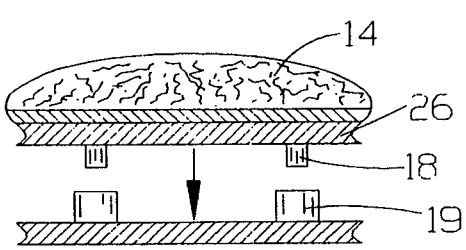
FIG. 3 shows a sectional view of line 2—2 taken on FIG. 1 with a version of the back washing device with snap fasteners.

Referring now to FIG. 3 is shown elongated loofah pad 14 being held in place by a plurality of male snap members 18 located along pad backing material 26 which is essentially the same size and shape as elongated loofah pad element 14. The corresponding female snaps are located along the face of central support element 21.

Fastening means include male and female snap elements 18 and 19, as well as miniature hooks and loops 16 and 17 which allow the easy replacement of elongated loofah pad element 14 when it is worn or permanently dirtied.

Figure 4:
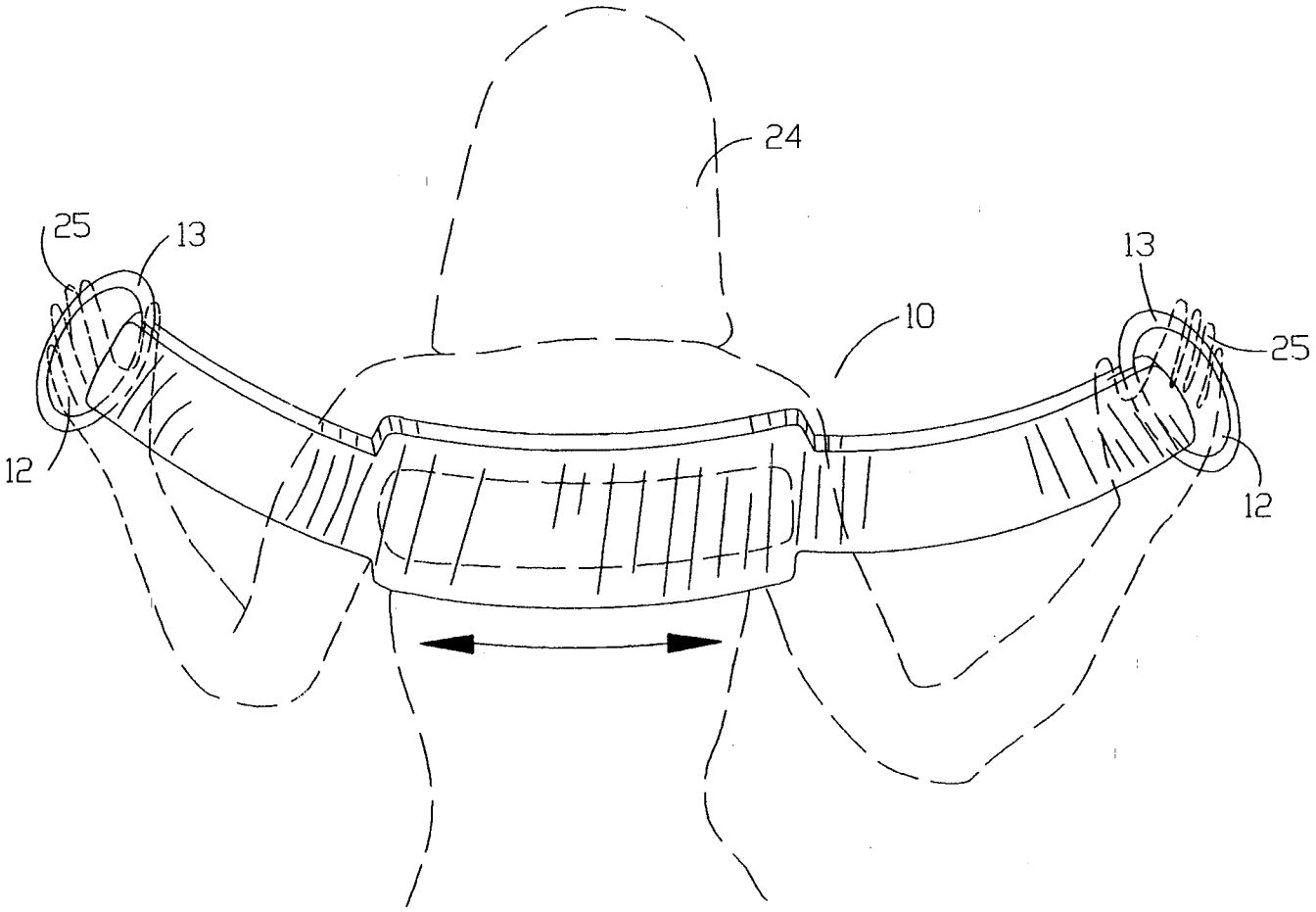
FIG. 4 shows a back view of a person using the back washing device.

And finally, FIG. 4 shows a back view of the user 24 of back washing device 10 manipulating elongated loofah pad element 14 across the user's back. Fingers 25 extend through open central portions 12 and easily grasp gripping members 13 for ready manipulation of elongated pad element 14 for cleansing, massaging and exfoliating the user's skin.

Although the foregoing disclosure of the present invention described but several preferred embodiments, it is anticipated that other variations and embodiments may be readily discerned therefrom.

What is claimed is:

1. An apparatus for cleansing and massaging the back of a person having:

an elongated loofah pad element for scrubbing and cleansing;

a thin flexible sheet of pad backing material approximately the same size as the elongated loofah pad element with said pad backing material bearing upon said loofah pad element wherein said pad backing material and said loofah pad element are attached together by stitching;

two elongated handle members, said elongated handle members each having outer marginal edges;

a central pad support element joining together the two elongated handle members;

two gripping members located along each of the outer marginal edges of the elongated handle members for grasping by the user to manipulate the loofah pad element;

fastening means for removably fastening the central pad support element to the pad backing material whereby the loofah pad element may be replaced when worn.

2. The device according to claim 1 wherein the fastening means are a plurality of miniature loops and hooks secured to the thin flexible sheet of pad backing material and central pad support elements, respectively.

3. The device according to claim 1 wherein the gripping members have open central portions for placing the user's fingers therethrough.

4. The device according to claim 1 wherein the gripping members are integral with the elongated handle members.

5. The device according to claim 1 wherein the central pad support element is integral with the elongated handle members.

6. The device according to claim 1 wherein the loofah pad element is substantially rectangular in shape.

7. The device according to claim 1 wherein the loofah pad element is substantially oval in shape.

8. The device according to claim 1 wherein the fastening means are a plurality of male or female snap members secured to the pad backing material with corresponding male or female snap members attached to the central pad support element.

* * * * *

UNITED STATES PATENT AND TRADEMARK OFFICE

CERTIFICATE OF CORRECTION

PATENT NO. : 5,386,609

DATED : Feb. 7, 1995

INVENTOR(S) : Dennis D. Xenos

It is certified that error appears in the above-identified patent and that said Letters Patent is hereby corrected as shown below:

| COLUMN | LINE | |
|---|---|---|
| 3 | 10 | After "material", insert --20--. |
| 3 | 20 | After "snaps", insert --19--. |

Signed and Sealed this

Second Day of May, 1995

*Attest:*

*Attesting Officer*

Bruce Lehman

BRUCE LEHMAN

*Commissioner of Patents and Trademarks*